US008300869B2

(12) United States Patent
Marlin et al.

(10) Patent No.: US 8,300,869 B2
(45) Date of Patent: Oct. 30, 2012

(54) LIGHTING AND AUDIO COMMUNICATION SYSTEM

(75) Inventors: Bruce Marlin, Ennis, TX (US); Alan Cross, Monroe, WI (US); Brad Diedrich, Oregon, WI (US); Loyd L. Ivey, Phoenix, AZ (US)

(73) Assignee: Mitek Corp., Inc., Phoenix, AZ (US)

( * ) Notice: Subject to any disclaimer, the term of this patent is extended or adjusted under 35 U.S.C. 154(b) by 0 days.

(21) Appl. No.: 12/752,560

(22) Filed: Apr. 1, 2010

(65) Prior Publication Data

US 2011/0255711 A1 Oct. 20, 2011

Related U.S. Application Data

(60) Provisional application No. 61/211,664, filed on Apr. 2, 2009.

(51) Int. Cl.

| | |
|---|---|
| ***H04R 1/02*** | (2006.01) |
| ***H04R 9/06*** | (2006.01) |
| ***F21V 33/00*** | (2006.01) |
| *H04R 1/00* | (2006.01) |
| *H04R 9/00* | (2006.01) |

(52) U.S. Cl. ..... 381/340; 381/333; 381/306; 381/388; 362/253; 181/141; 181/150

(58) Field of Classification Search ..... 381/340, 381/339, 347, 333, 306, 388; 362/253, 249.02, 362/249.06, 240; 181/141, 150, 152, 159, 181/177, 199; 116/137 R, 142 R See application file for complete search history.

(56) References Cited

U.S. PATENT DOCUMENTS

| | | | | | |
|---|---|---|---|---|---|
| 1,134,360 | A | * | 4/1915 | Walker | 340/815.69 |
| 1,665,826 | A | * | 4/1928 | Wheelan | 181/141 |
| 1,727,419 | A | * | 9/1929 | Volf, Jr. | 381/340 |
| 1,735,549 | A | * | 11/1929 | Seer | 181/141 |
| 1,965,791 | A | * | 7/1934 | Boffino | 181/199 |
| 2,093,957 | A | * | 9/1937 | Demetrius | 369/163 |
| 2,115,924 | A | * | 5/1938 | Flsher | 181/163 |
| 2,194,070 | A | * | 3/1940 | Giannini | 381/163 |
| 2,501,968 | A | * | 3/1950 | Sassin | 362/253 |
| 2,561,881 | A | * | 7/1951 | Oetting | 40/546 |
| 2,629,044 | A | * | 2/1953 | Marfisi | 40/431 |
| 2,924,661 | A | * | 2/1960 | Messeas, Jr. | 381/388 |
| 3,023,830 | A | * | 3/1962 | Hammes | 181/141 |
| 3,170,538 | A | * | 2/1965 | Detrick | 181/141 |
| 3,194,952 | A | * | 7/1965 | Wells | 362/86 |
| 3,642,091 | A | * | 2/1972 | Nohara et al. | 181/150 |

(Continued)

FOREIGN PATENT DOCUMENTS

DE 3844572 A1 * 2/1990

(Continued)

*Primary Examiner* — Edgardo San Martin
(74) *Attorney, Agent, or Firm* — Keith L. Jenkins, Registered Patent Attorney, LLC; Keith L. Jenkins

(57) ABSTRACT

A lighting and communication system with a horn enclosure for recessed ceiling panel or wall mounting, including a speaker with a horn expansion area to direct sound waves from the speaker to a horn enclosure front, at least one light enclosure located within the horn enclosure, the light enclosure defining a light cavity which is separated from said horn expansion area, with a light source inside the light cavity. The light source can be an LED array, which is capable of displaying text, colors or patterns in response to a control system signal.

18 Claims, 7 Drawing Sheets

U.S. PATENT DOCUMENTS

| | | | | | |
|---|---|---|---|---|---|
| 3,792,753 | A * | 2/1974 | Smith | 181/141 |
| 4,082,159 | A * | 4/1978 | Petty | 181/156 |
| 4,730,184 | A * | 3/1988 | Bach | 340/691.5 |
| 4,776,018 | A * | 10/1988 | Cordier | 381/336 |
| 4,790,020 | A * | 12/1988 | Lin | 381/351 |
| 4,875,143 | A * | 10/1989 | Fernandez | 362/86 |
| 5,471,018 | A * | 11/1995 | Nieuwendijk et al. | 181/152 |
| 5,637,840 | A * | 6/1997 | Kim | 181/152 |
| 5,654,705 | A * | 8/1997 | Houten et al. | 340/944 |
| 5,828,765 | A * | 10/1998 | Gable | 381/386 |
| 5,980,057 | A * | 11/1999 | Christie | 362/86 |
| 5,995,634 | A * | 11/1999 | Zwolski | 381/160 |
| 6,035,051 | A * | 3/2000 | Sato | 381/340 |
| 6,114,967 | A * | 9/2000 | Yousif | 340/690 |
| RE36,930 | E * | 10/2000 | Houten et al. | 340/944 |
| 6,127,918 | A * | 10/2000 | Lin | 340/388.1 |
| 6,236,622 | B1 * | 5/2001 | Blackman | 368/10 |
| 6,345,685 | B1 * | 2/2002 | Wells et al. | 181/153 |
| 6,598,711 | B2 * | 7/2003 | Barmet | 187/395 |
| 6,746,135 | B2 * | 6/2004 | Tsang | 362/253 |
| 6,748,096 | B2 * | 6/2004 | Chuang | 381/395 |
| 6,942,060 | B2 * | 9/2005 | Sugiura et al. | 181/199 |
| 7,014,565 | B2 * | 3/2006 | Chang | 473/118 |
| 7,123,738 | B1 * | 10/2006 | Mizone et al. | 381/406 |
| 7,467,881 | B2 * | 12/2008 | McMillen | 362/364 |
| 7,476,002 | B2 * | 1/2009 | Wolf et al. | 362/231 |
| 7,604,378 | B2 * | 10/2009 | Wolf et al. | 362/253 |
| 7,606,379 | B2 * | 10/2009 | Ivey et al. | 381/160 |
| 8,042,961 | B2 * | 10/2011 | Massara et al. | 362/86 |
| 8,077,901 | B2 * | 12/2011 | Ishii | 381/388 |
| 2003/0031330 | A1 * | 2/2003 | Kim | 381/111 |
| 2004/0170292 | A1 * | 9/2004 | Vincenot | 381/350 |
| 2004/0175014 | A1 * | 9/2004 | Liu | 381/386 |
| 2006/0060415 | A1 * | 3/2006 | Radu et al. | 181/150 |
| 2006/0078138 | A1 * | 4/2006 | Wada | 381/306 |
| 2006/0185930 | A1 * | 8/2006 | Shu | 181/148 |
| 2006/0201740 | A1 * | 9/2006 | Hsueh | 181/199 |
| 2007/0222631 | A1 * | 9/2007 | Haase | 340/691.5 |
| 2009/0097691 | A1 * | 4/2009 | Eaton | 381/388 |
| 2011/0080733 | A1 * | 4/2011 | Wang | 362/253 |
| 2011/0188240 | A1 * | 8/2011 | Simon et al. | 362/234 |
| 2011/0317861 | A1 * | 12/2011 | Haase | 381/333 |

FOREIGN PATENT DOCUMENTS

DE 3928253 A1 * 2/1991

* cited by examiner

LIGHTING AND AUDIO COMMUNICATION SYSTEM

RELATIONSHIP TO OTHER APPLICATIONS

This application claims the benefit of provisional application Ser. No. 61/211,664 filed Apr. 2, 2009 naming the same inventors.

FIELD OF THE INVENTION

The present invention relates to a combination lighting and audio communication system for use in ceilings and walls, and more particularly to a modular system for providing both light and sound in a commercial suspended ceiling panel system.

BACKGROUND OF THE INVENTION

It is well known in the art to use various types of incandescent and fluorescent light sources for residential and commercial buildings, mounting them into a ceiling tile or drywall type ceiling or wall. Light sources are provided in either surface mounted or recessed configurations, and in the case of recessed mountings the housings can be cylindrical, square or rectangular. The square and rectangular light sources can be sized for mounted directly into ceiling grids where no cutting of tiles is required.

There have been recent developments which utilize low voltage or Light Emitting Diode (LED) sources in place of the traditional incandescent and fluorescent lights. These LED arrays are smaller in physical size with a nearly flat profile, lending themselves to low ceilings with limited plenum space or even low profile surface applications. The LED arrays are also much more energy efficient that traditional light sources, and offer the option of multiple colors and rapid on/off cycles.

It is also well known in the art that various speaker arrangements are used in a variety of recessed enclosures intended for use in suspended and drywall type ceilings and walls in residential and commercial buildings. The speakers can be either the traditional cone and magnet type, or a transducer type attached to a transmitting surface. Other audio sources can also be incorporated, such as sirens, piezo buzzers, whistles and the like. Traditional speakers can be furnished in specialized audio ranges such as woofers, mid-range, and tweeters. The various audio devices can be powered by a centralized amplifier, and controlled by an audio source such as a radio, CD or MP3 player, microphone, or computer controlled announcement system. The audio source can send a single output signal such as background music or paging to all the speakers, or it can send specialized audio outputs to speakers in certain zones, such as localized announcements in airports. The audio devices can also be supplied with a receiver to receive wireless transmission of an audio signal from a remote transmitter.

Ceiling and wall mounted lights and speakers are generally mounted separately from each other, as the electrical power and control systems for each are completely different. There have been some light and speaker combinations proposed for recessed mounting in ceilings and walls, but most of these known systems are intended for home use, and were not envisioned for large commercial applications. In addition, the lighting in these configurations was intended strictly for illumination, and did not have any implications for emergency assistance such as fire, weather emergency, or other communication applications. Combination lights and speakers have consisted of lights mounted directly in front of the speaker components, which has wattage limitations in terms of heat generation, and can create a fire hazard if the lamps used become too hot.

SUMMARY OF THE INVENTION

The present invention includes lighting and audio components in the same fixture to create a lighting and communications panel. The panel assembly includes a square or rectangular enclosure having a size and shape often corresponding to various suspended ceiling tiles or modular lighting. The edges of the enclosure are configured to fit into standard ceiling grids, or to be flush mounted into a new or existing wall or ceiling structure. There is a lighting element generally parallel with the front edge of the tray, and which covers substantially the entire opening of the tray. The lighting element can consist of traditional lighting sources such as incandescent, fluorescent, neon, or HID.

Alternatively the lighting element used in the assembly may consist of an LED array, of generally two types. A top firing LED array has many LED's positioned in grid patterns on a generally flat panel. This plurality of LED's can be programmed to light individually in a desired sequence, in order to form letters, numbers, or various shapes including arrows, chevrons, logos, or symbols. The shapes and symbols can be programmed to scroll along a linear path, or to simulate motion in any direction.

A second variation is a side firing LED array, in which LED's are arranged around the edge of a translucent panel, to light the panel from only the edges. In either configuration, the LED's are capable of changing color, so the desired shapes can also be programmed in many color combinations. The side firing LED array also lends itself well to a transducer type audio system, which would keep the overall height of the assembly very low. Either of the lighting arrangements can be controlled from a common power source and switched in banks similar to traditional lighting schemes. Alternatively, the lighting assemblies can be individually controlled from a computer or circuit board driven system which would allow individual control of each light assembly and facilitate communication via changing colors or shapes generated by the lights.

The lighting tray assembly also includes at least one audio speaker driver which is mounted on top or in back of the tray so that it is not visible after mounting of the assembly. Normally this audio system will be in a completely different compartment than the lighting, separating the two systems for better heat and vibration resistance, and compliance with commercial fire codes. In order to route the audio waves from the rear of the tray to the front of the assembly, at least one flat horn is utilized. This flat horn, in one configuration accepts the sound from the audio speaker driver, extends laterally around the back of the tray, and exits out at least one narrow slot at the front of the assembly. In another configuration, at least one speaker driver is used in combination with at least two flat horns, to direct the sound along at least two separate paths to two narrow outlets in the front of the enclosure. In this way, the speaker is concealed, virtually the entire surface of the lighting array is maintained, and the audio waves can travel unobstructed from the driver to the narrow front outlets. The shape of the flat horns can be adjusted to create the audio signal desired. For example the horns can have the same cross section from their audio source to their outlet, or they can expand in size from the source to the outlet, or even reduce in size as they approach the outlet. The horns can even be created in a labyrinth so that a long horn path can be contained in a smaller space. These light and speaker assemblies can be arranged throughout the ceiling area, in order to deliver distributed light and sound throughout the area.

Another configuration is to utilize a transducer type audio system where one or more audio transducers are attached to a flat panel to transmit the audio signal directly without the use of the flat horn to direct the sound waves.

While the speaker system can certainly be used for the more traditional background music, white noise or paging functions, the combination with the versatile LED lighting array creates some very unique opportunities. For example, the lights can be individually and independently programmed to respond in pre-determined ways to certain audio signals. For example, in the case of a fire signal sent to the audio system, the lighting system can display red arrows or chevrons indicating the best path to an exit. The LED array could also display scrolling text to indicate the emergency or hazard, including several languages or pictorial displays. Weather, chemical, or other hazard situations could be handled in a similar fashion. A code blue emergency in a hospital setting could be programmed to indicate blue chevrons to guide responders to the appropriate location while the audio system announces the information.

An additional opportunity would be for the lights to respond automatically to a particular audio frequency. For example, the LED's can be programmed to display chevrons or text in response to a known fire alarm or siren frequency. This programmed response could be passive, meaning that it would work with remote audio sources not directly connected to the communications panel itself.

In addition to ceiling grid and wall mounted applications of this invention, there are also many other opportunities which the inventors have envisioned, including;

a. multiple types of speaker drivers in one assembly for paging, fire, noise masking, etc,
b. large LED arrays with combined audio for use in stage, concert, sports, or auditorium applications,
c. floor integrated panels for use in discos and sports arenas (hockey, curling), etc,
d. gaming machines with integrated light and sound,
e. retail POP displays with illuminated and audio messages,
f. vehicle dome or backup lights, or displays with audio,
g. emergency vehicle light displays with audio,
h. baby monitor with night light and audio,
i. LED flashlight with integrated audio.

DETAILED DESCRIPTION OF THE BEST MODES AND PREFERRED EMBODIMENTS OF THE INVENTION

Figure 1:
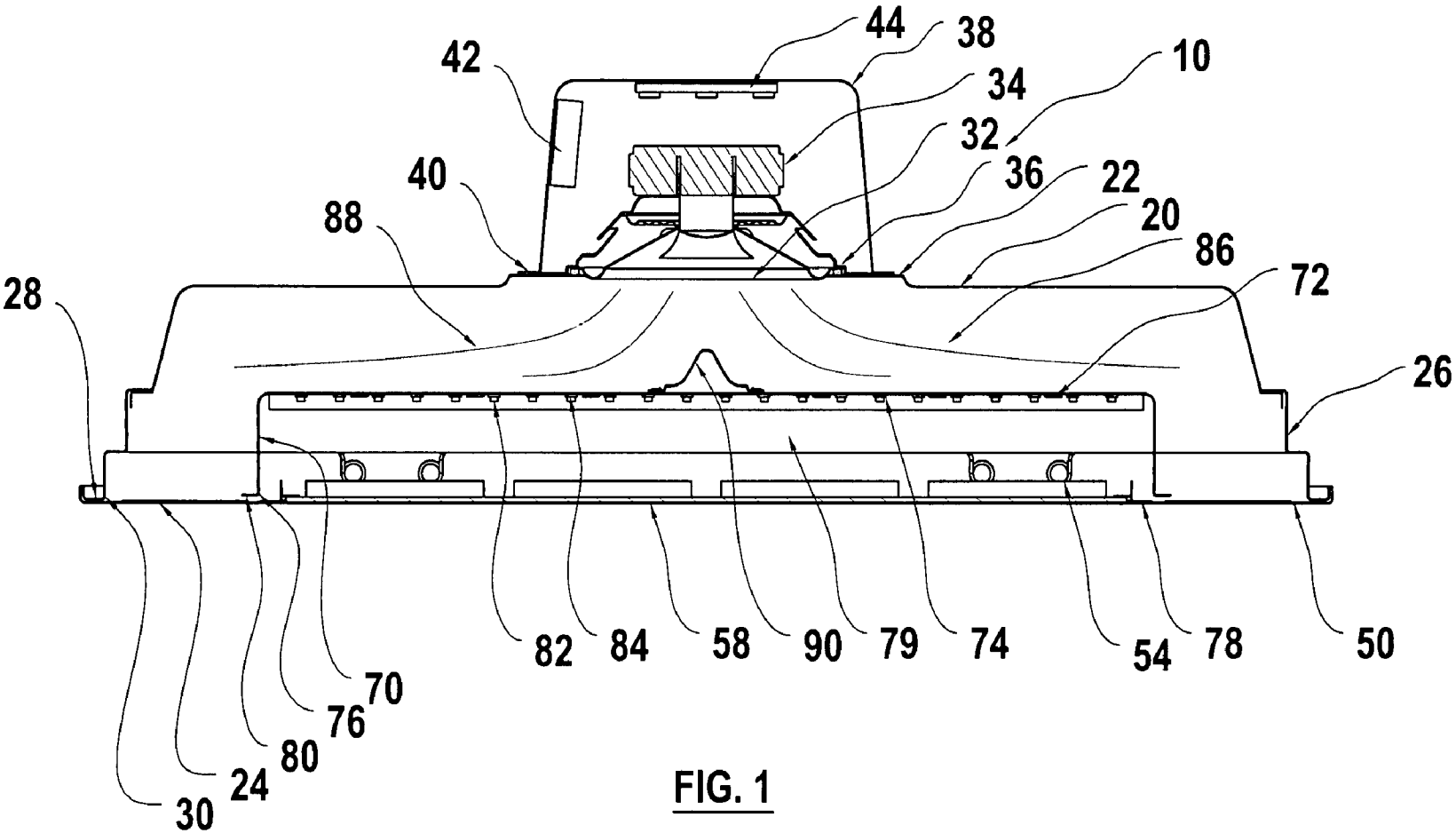
FIG. 1 is a side view cross-section illustrating the exemplary embodiment of the present invention.

The above and other objects and advantages of the present invention will become more apparent from the following description taken in conjunction with the following drawings in which:

FIG. 1 is a side view cross-section illustrating the exemplary embodiment of the lighting and communication system 10. A horn enclosure 20 is a relatively wide and flat assembly often made out of sheet steel or other heat resistant materials. The horn enclosure 20 includes a horn enclosure back 22, a horn enclosure front 24, and horn enclosure sides 26, which together define the tray shape of the assembly. A horn enclosure flange 28 is located adjacent to the horn enclosure sides 26, and extends the entire perimeter of the horn enclosure front 24 to define the horn enclosure opening 30. Adjacent to the horn enclosure back 22 is at least one speaker aperture 32 which is designed to accept a speaker 34. The speaker 34 has a series of speaker mounts 36 which correspond to the shape and size of the speaker aperture 32, and the speaker 34 is held in position using clips or fasteners (not shown). The speaker 34 is typically powered and driven by a system including power amplifiers, equalizers, computers, digital sound processors and other means of control, which can be located either locally in each enclosure or remote to run a series of light and audio devices. The combination light and audio device can also have it's own individual IP address to create a variety of zones or paging areas.

A speaker housing 38 provides a protective covering over the speaker 34, and is often required by local or federal fire codes. The speaker housing 38 is a generally pan or bowl shaped assembly with one open side defined by a speaker housing flange 40 around the perimeter. The speaker housing 38 can be designed in a variety of shapes and sizes depending on the particular application, and is generally attached via the speaker housing flange 40 to the horn enclosure back 22 using clips, adhesive, hinges or fasteners (not shown).

The speaker housing 38 can also be used to mount and protect various other equipment 42, which may include wiring, amplifiers, transformers, or wireless receivers. The speaker housing 38 can also provide an enclosure for a lighting circuit board 44 for controlling various lighting functions or other aspects of the device.

Figure 2:
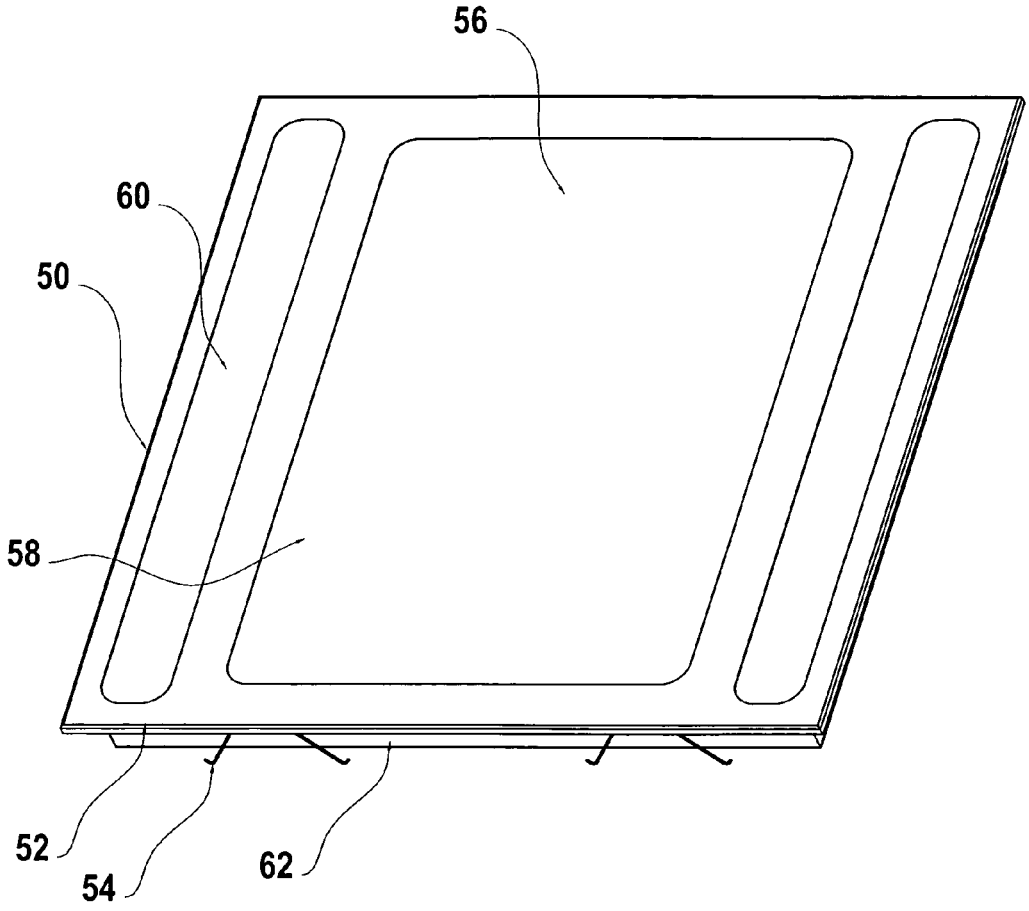
FIG. 2 is an isometric view of the lighting aperture on the bottom side of the present invention.

FIG. 2 is an isometric view of the lighting and audio communication system 10 and shows a trim ring 50 which is provided to be mounted over the horn enclosure front 24 to conceal the horn enclosure 20 as shown in FIG. 1. The trim ring 50 includes a trim ring flange 52 which is at the outer edge of the trim ring 50 and is similar in size and shape to the horn enclosure flange 28 shown in FIG. 1. The trim ring flange 52 of the trim ring 50 is attached adjacent to the horn enclosure flange 28 at the horn enclosure front 24 using a plurality of spring clips 54 or similar attachment devices as shown in FIG. 1. The trim ring 50 includes at least one lighting aperture 56 for the light to be able to shine through. In order to control the resulting light, a lens 58 is provided to fit in the lighting aperture 56. The lens 58 can be a clear or translucent panel, either flat or textured to diffuse the light. The lens 58 could also include a grid or crate assembly (not shown) to further control or diffuse the light. The trim ring 50 also includes at least one audio aperture 60 for allowing the audio waves to escape from the horn enclosure front 24 as shown in FIG. 1. The trim ring 50 often includes a trim stiffener 62 which helps to retain the shape and rigidity of the trim ring 50. The spring clips 54 are sometimes attached to this trim stiffener 62 to retain the trim ring 50 to the horn enclosure flange 28.

As shown in FIG. 1, a light enclosure 70 is disposed adjacent to and above the trim ring 50, and generally centered inside the horn enclosure 20. The light enclosure 70 includes a light enclosure back 74, light enclosure sides 76, and a light enclosure front 78, which together define a light cavity 79. There is sometimes a light enclosure flange 80 adjacent to the light enclosure front 78, and normally extends outward around the perimeter of the light enclosure front 78. The light enclosure flange 80 or light enclosure sides 76 are attached to the horn enclosure sides 26 of the horn enclosure 20 by a series of tabs 72 or other means of fastening together.

The space created between the light enclosure back 74 and light enclosure side 76 of the light enclosure 70, and the horn enclosure back 22 and horn enclosure side 26 of the horn enclosure 20 defines a horn expansion area 86. The purpose of the horn expansion area 86 is to guide sound waves 88 emanating from the speaker 34 towards the audio aperture 60 of the trim ring 50 and into the ambient area adjacent the horn enclosure opening 30. In order to further guide the sound waves 88, a bifurcation bar 90 may be attached to either the light enclosure back 74 or the horn enclosure 20 to split the sound waves 88 into two or more directions of flow.

Inside the light cavity 78 is a light source 82 which is electrically powered with either a 120 VAC house current or a low voltage power supply, and attached to the light enclosure back 74. One embodiment of the light source 82 is an LED array 84, which consists of a plurality of bulbs in a plurality of rows. Other light sources 82 include fluorescent or incandescent lights. There may be a plurality of tabs 72 at various heights along the horn enclosure sides 26 to allow a number of different distances between the light enclosure 70 and the lens 58 to provide a variation of diffusion levels of the light source 82.

The light sources 82 or LED array 84 may be controlled by a lighting circuit board 44, which can also be located remotely to control a series of lights. The lighting circuit board 44 can control many aspects of the LED array 84 including brightness, color, patterns, text, scrolling, graphic movement, and power management.

Figure 3:
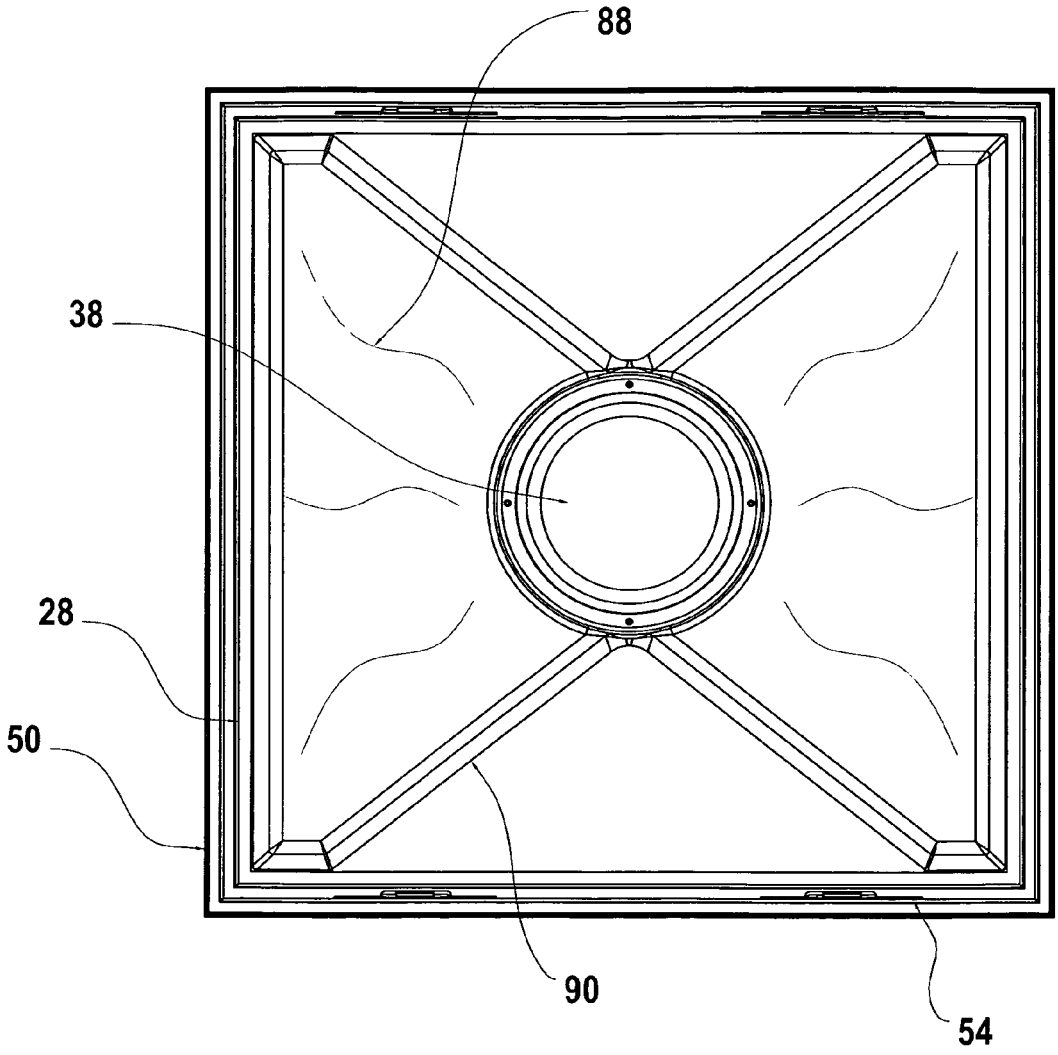
FIG. 3 is a top view of the lighting and audio communication system.

FIG. 3 and FIG. 8 are top views of the lighting and audio communication system 10, and illustrates that in order to further enhance the flow of the sound waves 88 toward the audio aperture 60 shown in FIG. 2, horn guides 90 can be added to the horn enclosure 20, or to the light enclosure back 74 as shown in FIG. 1. The horn guides 90 are generally narrow adjacent to the speaker aperture 32, and expand to be much wider as they approach the audio aperture 60 shown in FIG. 2. The sound waves 88 shown in FIG. 3 are shown to expand from their source at the speaker aperture 32 toward the horn enclosure opening 30 and audio aperture 60 shown in FIG. 1 and FIG. 2.

Figure 4:
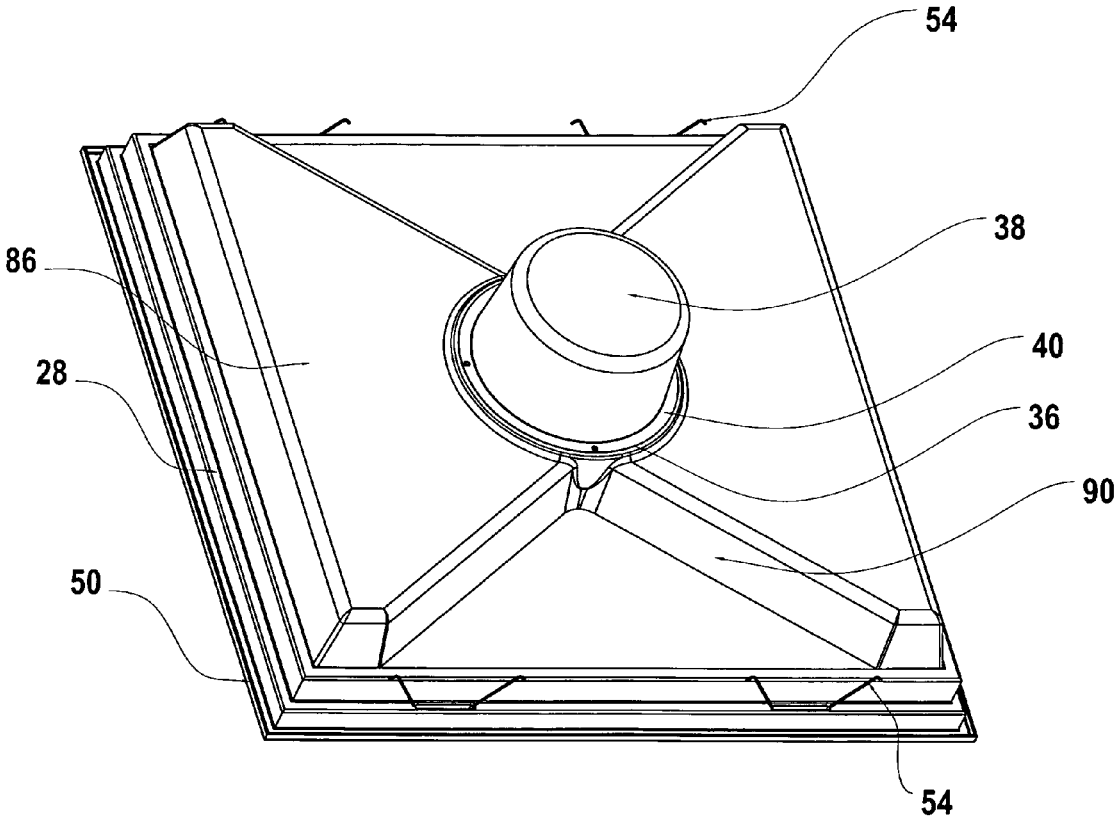
FIG. 4 is an isometric view from the top side of the lighting and audio communication system, showing the various horn guides and speaker mounts.

FIG. 4 and FIG. 9 are isometric views from the top side of the lighting and audio communication system 10, and more clearly shows the horn guides 90, speaker mount 36 and speaker mounting flange 40. It is also envisioned that there could be a plurality of speakers 34 arranged in multiple speaker housing flanges 40 and with additional horn guides 90. The multiple speakers 34 as shown in FIG. 1 could be a combination of audio ranges such as woofer, midrange and tweeter, or a combination of usage such as sirens, buzzers and loudspeakers.

Figure 5:
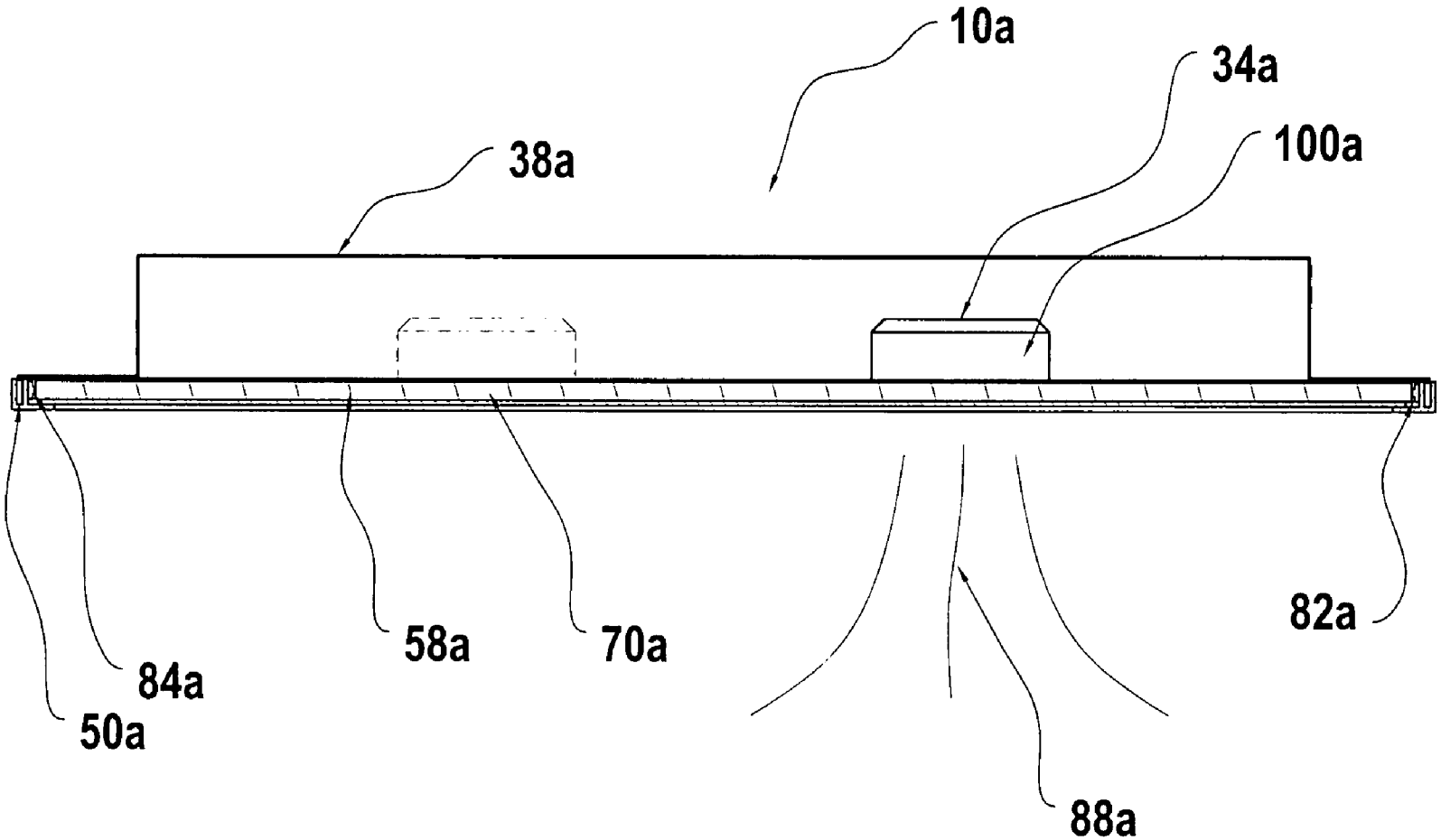
FIG. 5 is a side view of another exemplary version of the lighting and audio communication system.
Figure 6:
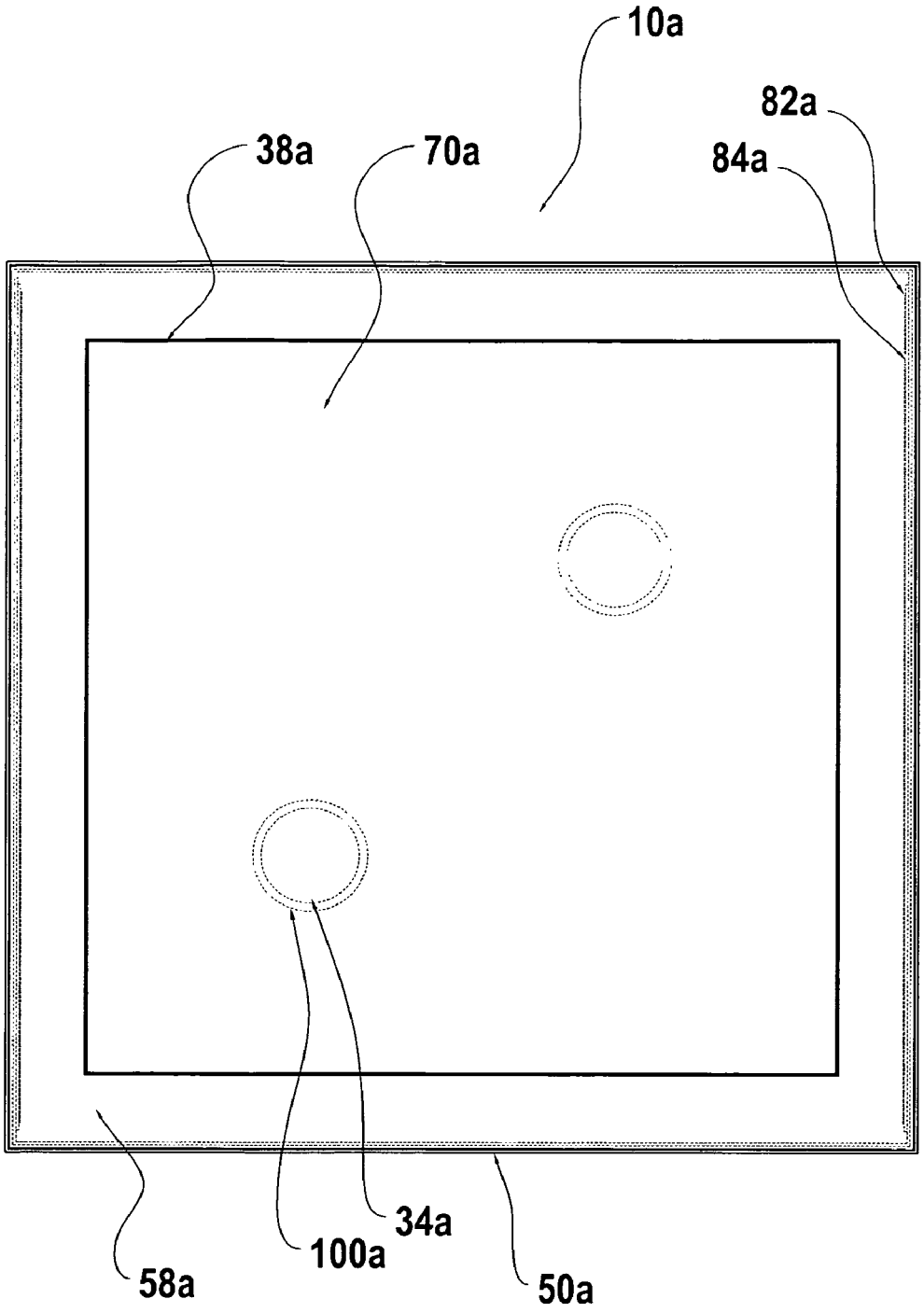
FIG. 6 is top view of another exemplary version of the lighting and audio communication system.

FIG. 5 and FIG. 6 are a side and top view respectively of another version of the lighting and audio communication system 10*a*. The light enclosure 70*a* of the lighting and audio communication system 10*a* consists of a frame 50*a* surrounding a lens 58*a* which can be clear or translucent glass or plastic. The speakers 34*a* consist of at least one contact transducer 100*a* which attaches directly to the lens 58*a* of the light enclosure 70*a* to produce audio sound waves 88*a*.

The light source 82*a* in this application consists of a side firing LED array 84*a* where the LED's are disposed around one or more edges of the lens 58*a* of the light enclosure 70*a*. A relatively flat speaker housing 38*a* is disposed above the light enclosure 70*a* to protect the transducer 100*a* of the speaker 34*a*, and is removably attached to the frame 50*a* of the light enclosure 70*a*. The result of this configuration is a more flat overall shape, capable of being mounted in a ceiling grid, but more appropriate for surface or wall mounting.

FIG. 6 more clearly showing the possible location of multiple transducers 100*a* of the speaker 34*a* attached to the lens 58*a*.

Figure 7:
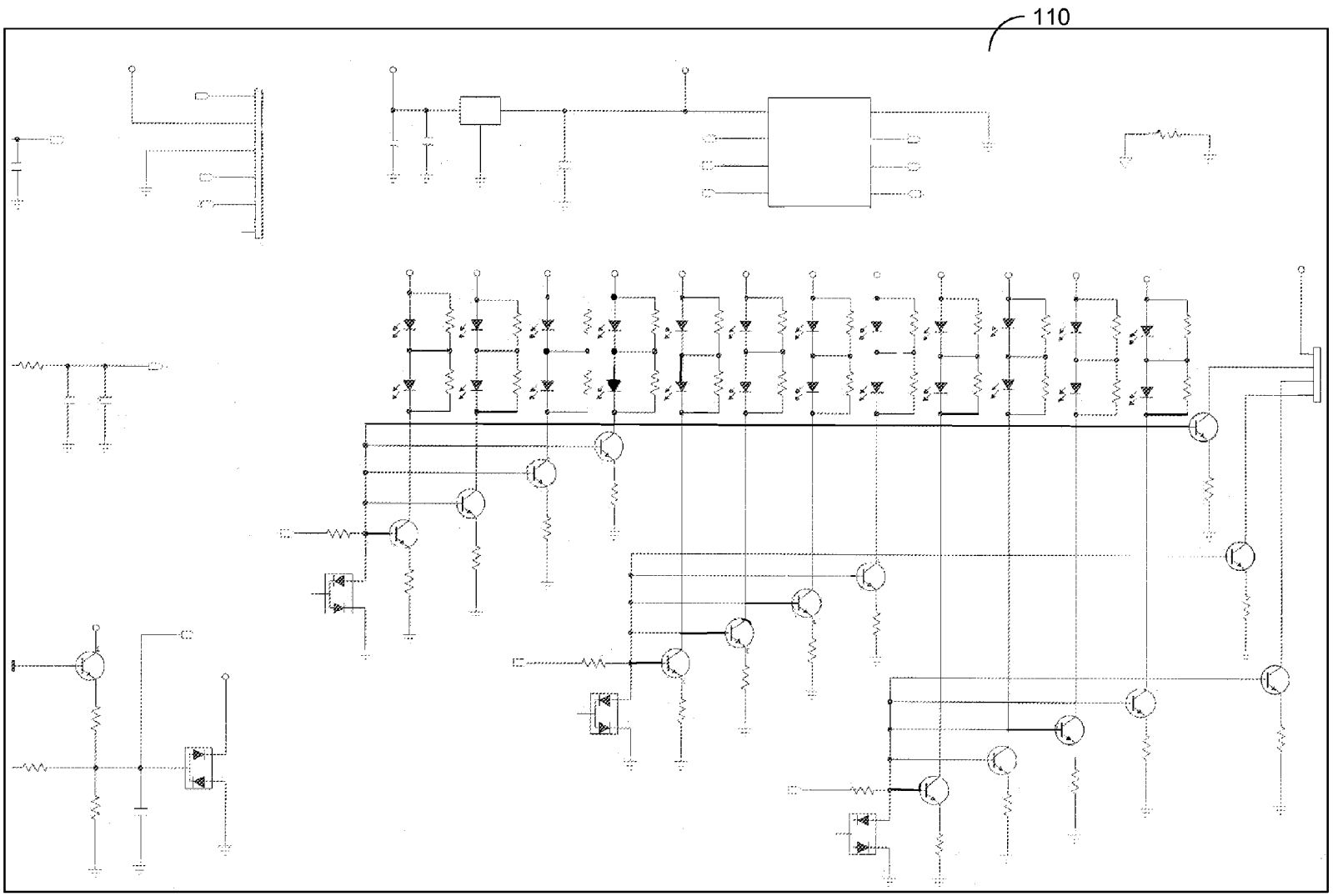
FIG. 7 is an electronic schematic showing one possible circuit board configuration for controlling the combination of lights and speakers in the lighting and audio communication system.

FIG. 7 is an electronic schematic showing one possible circuit board configuration for controlling the combination of lights and speakers in the lighting and audio communication system 10. This control system 110 can include changing the color or intensity of the lights, forming shapes such as chevrons, graphics or pictorials, text, or scrolling text in several languages. It can also control the audio components to send verbal messages, sounds or other signals as programmed. It can also be configured to prompt an automatic visual lighting sequence based on a pre-determined audio frequency or pattern such as a fire alarm, bell or siren.

We claim:

1. A lighting and communication system comprising;

a horn enclosure comprising at least one rear speaker aperture;

at least one speaker mounted exterior to said horn enclosure adjacent said at least one speaker aperture;

at least one horn expansion area inside said horn enclosure to direct sound waves from said at least one speaker to a horn enclosure front;

at least one light enclosure located entirely within said horn enclosure, wherein said light enclosure defines a light cavity which is separated from said horn expansion area by said light enclosure, said light enclosure comprising at least one light source coupling mounted within said light cavity.

2. A lighting and communication system according to claim 1 in which said horn enclosure is square or rectangular in shape.

3. A lighting and communication system according to claim 1 in which a light source is coupled to said light source coupling and wherein said light source comprises an LED array.

4. A lighting and communication system according to claim 1 in which said light cavity is completely separated from said horn expansion area.

5. A lighting and communication system according to claim 1 in which said light enclosure comprises a light enclosure back, and said light source coupling is mounted adjacent to said light enclosure back.

6. A lighting and communication system according to claim 1 in which said light enclosure comprises a light enclosure side, and said light source coupling is mounted adjacent to said light enclosure side.

7. A lighting and communication system according to claim 1 in which a light source coupled to said light source coupling is capable of being controlled by a control system, said control system comprising a computer or other digital control equipment in order to allow said light source to display text, colors, or patterns.

8. A lighting and communication system according to claim 7 in which said control system is capable of changing said light source display text, colors or patterns in response to sound waves emitting from said horn enclosure.

9. A lighting and communication system according to claim 7 in which said control system is capable of changing said light source display text, colors or patterns in response to sound emitting from external sources comprising at least one of bells and alarms.

10. A lighting and communication system according to claim 1 in which said speaker is replaceable.

11. A lighting and communication system according to claim 1 in which said horn expansion area increases in volume as it approaches said horn enclosure front.

12. A lighting and communication system according to claim 1 in which said lighting and communications system is individually addressable by said control system adapted to use an individual internet protocol address.

13. A lighting and communication system according to claim 1 in which said lighting and communications system is communicatively coupled to at least one of commercial and emergency communications applications.

14. A lighting and communication system according to claim 1 in which said horn expansion area includes a bifurcation bar to assist in dividing said sound waves toward multiple horn enclosure openings.

15. A lighting and communication system according to claim 14 in which said multiple horn openings number at least two.

16. A lighting and communication system according to claim 1 in which said speakers number at least two.

17. A lighting and communication system according to claim 1 in which said speaker comprises a contact transducer.

18. A lighting and communication system comprising;

a horn enclosure comprising at least one rear speaker aperture;

at least one speaker mounted exterior to said horn enclosure adjacent said at least one speaker aperture;

at least one horn expansion area inside said horn enclosure to direct sound waves from said at least one speaker to a horn enclosure front;

at least one light enclosure located entirely within said horn enclosure;

said light enclosure comprising at least one LED array mounted within said light enclosure;

said LED array capable of displaying text, colors or patterns in response to a signal received from a digital control system.

* * * * *